US007671809B2

(12) United States Patent
Cheng et al.

(10) Patent No.: US 7,671,809 B2
(45) Date of Patent: Mar. 2, 2010

(54) ANTENNA DEVICE WITH ION-IMPLANTED ANTENNA PATTERN

(75) Inventors: Yu-Chiang Cheng, Taipei (TW); Ping-Cheng Chang, Chaozhou Town (TW); Cheng-Zing Chou, Xinying (TW)

(73) Assignee: Getac Technology Corporation, Hsinchu (TW)

( * ) Notice: Subject to any disclaimer, the term of this patent is extended or adjusted under 35 U.S.C. 154(b) by 781 days.

(21) Appl. No.: 11/404,814

(22) Filed: Apr. 17, 2006

(65) Prior Publication Data

US 2007/0216582 A1 Sep. 20, 2007

(30) Foreign Application Priority Data

Mar. 14, 2006 (TW) ..... 95108648 A

(51) Int. Cl.
*H01Q 1/24* (2006.01)

(52) U.S. Cl. ..... 343/702; 343/873; 343/700 MS

(58) Field of Classification Search ..... None
See application file for complete search history.

(56) References Cited

U.S. PATENT DOCUMENTS

| | | | | |
|---|---|---|---|---|
| 7,339,533 | B2 * | 3/2008 | Kurashima et al. | 343/702 |
| 2002/0075186 | A1 * | 6/2002 | Hamada et al. | 343/700 MS |
| 2002/0089456 | A1 * | 7/2002 | Hamada | 343/702 |
| 2003/0181227 | A1 | 9/2003 | Toshiyuki | |
| 2004/0051670 | A1 | 3/2004 | Sato | |
| 2005/0001767 | A1 | 1/2005 | Wulff et al. | |
| 2005/0093752 | A1 | 5/2005 | Cheng et al. | |
| 2005/0146475 | A1 | 7/2005 | Bettner et al. | |
| 2007/0216582 | A1 * | 9/2007 | Cheng et al. | 343/702 |
| 2008/0018551 | A1 * | 1/2008 | Cheng et al. | 343/873 |
| 2008/0297420 | A1 * | 12/2008 | Cheng et al. | 343/702 |

FOREIGN PATENT DOCUMENTS

| | | |
|---|---|---|
| JP | 58087818 A | 5/1983 |
| TW | 490880 | 6/2002 |

OTHER PUBLICATIONS

Wong, K., et al.; "A broad-band single-patch circularly polarized microstrip antenna with dual capacitively-coupled feeds"; IEEE Trans. on Antennas and Propagation; vol. 49, No. 1; Jan. 2001; pp. 41-44.

Y.Q. Wang et al, "Polymer Modification by Ion Implantation: Electrical Conductivity and Applications," Desk Reference of Functional Polymers Syntheses and Applications, American Chemical Society, pp. 387-404, Washington DC,1997.

Y.Q. Wang et al, "Polymer Modification by Ion Implantation: Ion Bombardment and Characterization," Desk Reference of Functional Polymers Syntheses and Applications, American Chemical Society, pp. 371-385, Washington DC,1997.

(Continued)

*Primary Examiner*—Trinh V Dinh
(74) *Attorney, Agent, or Firm*—Quintero Law Office

(57) ABSTRACT

Disclosed is an antenna device for transceiving a wireless signal with an ion-implanted antenna pattern implanted inside a casing of an electronic device. The ion-implanted antenna pattern is connected to an antenna module of a motherboard of the electronic device in order to feed the wireless signal transceived by the ion-implanted antenna pattern, while the connection could be either by an antenna signal feeding line connected to the ion-implanted antenna pattern and the antenna module, or by an antenna coupling element coupled with the ion-implanted antenna pattern and connected to an antenna signal feeding line.

6 Claims, 13 Drawing Sheets

OTHER PUBLICATIONS

Ryan E. Griedd et al, "Electrical and Optical Behavior of Ion-Implanted and Ion-Beam Mixed Polymers," SPIE vol. 3413, pp. 27-36, Quebec, Canada, Jul. 1998.

Y.Q. Wang et al, "Ion Beam Modification and Analysis of Metal/Polymer bi-layer thin films," Nuclear Instruments and Methods in Physics Reasearch, B 219-220, pp. 798-803, 2004 Elsevier B.V.

* cited by examiner

ANTENNA DEVICE WITH ION-IMPLANTED ANTENNA PATTERN

RELATED APPLICATIONS

This application claims priority under 35 U.S.C. 119 to an application Taiwan 95108648 on Mar. 14, 2006, the contents of which are incorporated herein by reference.

FIELD OF THE INVENTION

The present invention relates to an antenna device used in wireless technology, and in particular to an antenna device with ion-implanted antenna pattern.

BACKGROUND OF THE INVENTION

It is well known that an antenna is the key element to transmit/receive (transceive) microwaves in wireless technology such as wireless communication and wireless data transfer, where the antenna transforms electrical currents generated by a transmitter into microwaves and transmits the microwaves in free space. The antenna also captures microwaves and transforms them into electrical currents, which are then processed by a receiver. As a result, the characteristics of the antenna deeply affect that of the wireless technology, and the antenna can be referred as the index to examine the quality of the wireless technology.

Among numerous kinds of electronic devices utilizing wireless signal transceiving, the making and the dimension of the antennas used by such devices are not entirely the same. The use of the appropriate antenna not only matches the features of the electronic devices and enhances the quality of the transceiving of a wireless signal, but also reduces the cost of manufacturing the electronic devices.

As shown in FIG. 1, which shows the conventional arrangement of the antenna used in an electronic device, an electronic device, which is generally denoted a numeral reference 1, includes a casing 11, a backlight module 12, an anti-Electromagnetic Interference (anti-EMI) plate 13, and a second casing 14. An antenna 15, which is electrically connected to an antenna module 171 of an motherboard 17 of the electronic device 1 by an antenna signal feeding line 16, is arranged on the inner surface of the second casing 14, and such electrical connection involves the conducting of a wireless signal from the antenna module 171 to the antenna 15 and vice versa.

Further, besides a direct wire connection between the antenna module and the antenna by the antenna signal feeding line as shown in FIG. 1, the method of coupling feeding, which the antenna signal feeding line is electrically connected to an antenna coupling element but not to the antenna and the transceiving of signals between the antenna module and the antenna is by the coupling of the antenna coupling element and the antenna, is also feasible.

Antennas such as dipole antennas, plate antennas, or PIFA antennas used in electronic devices for transceiving wireless signals of conventional use are usually a separate antenna device mounted on a base or a casing of the electronic devices. Although some of the conventionally used antennas in the market are arranged at a predetermined position inside the electronic device, they are in fact individually manufactured and then arranged in and electronically connected to the electronic devices. Such manufacturing is not only troublesome bust also increases costs.

SUMMARY OF THE INVENTION

A primary object of the present invention, therefore, is to provide an antenna device with a simple structure directly implanted inside the electronic device. Besides, another object of the present invention is to provide an antenna device applying the Ion-Implantation process, and a further object of the present invention is to provide an antenna device that co-structured with the casing of the electronic device.

To realize the above objects, the present invention installs an antenna device for transceiving a wireless signal with an ion-implanted antenna pattern directly implanted inside a casing of an electronic device by applying the process of the Ion-Implantation accompanies with the method of direct wire connection or coupling feeding. The ion-implanted antenna pattern is connected to an antenna module of a motherboard of the electronic device in order to feed the wireless signal transceived by the ion-implanted antenna pattern, while the connection could be either by an antenna signal feeding line directly connected to the ion-implanted antenna pattern and the antenna module, or by an antenna coupling element coupled with the ion-implanted antenna pattern and connected to an antenna signal feeding line.

In the preferred embodiment of the present invention, the antenna pattern can be arranged either on the surface of the casing, embedded in the casing and formed with the surface, or formed inside the casing and adjacent to the surface.

In comparison with the conventional technologies, which the antennas are in fact individually manufactured and then arranged in the electronic devices, the present invention directly implants an ion-implanted antenna pattern inside the structure of an electronic device by applying the process of Ion-Implantation accompanying a direct wire connection or a coupling feeding. Further, the present invention can be adapted into a wide range of electronic devices when used in different fields of application.

These and other objects, features and advantages of the invention will be apparent to those skilled in the art, from a reading of the following brief description of the drawings, the detailed description of the preferred embodiment, and the appended claims.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
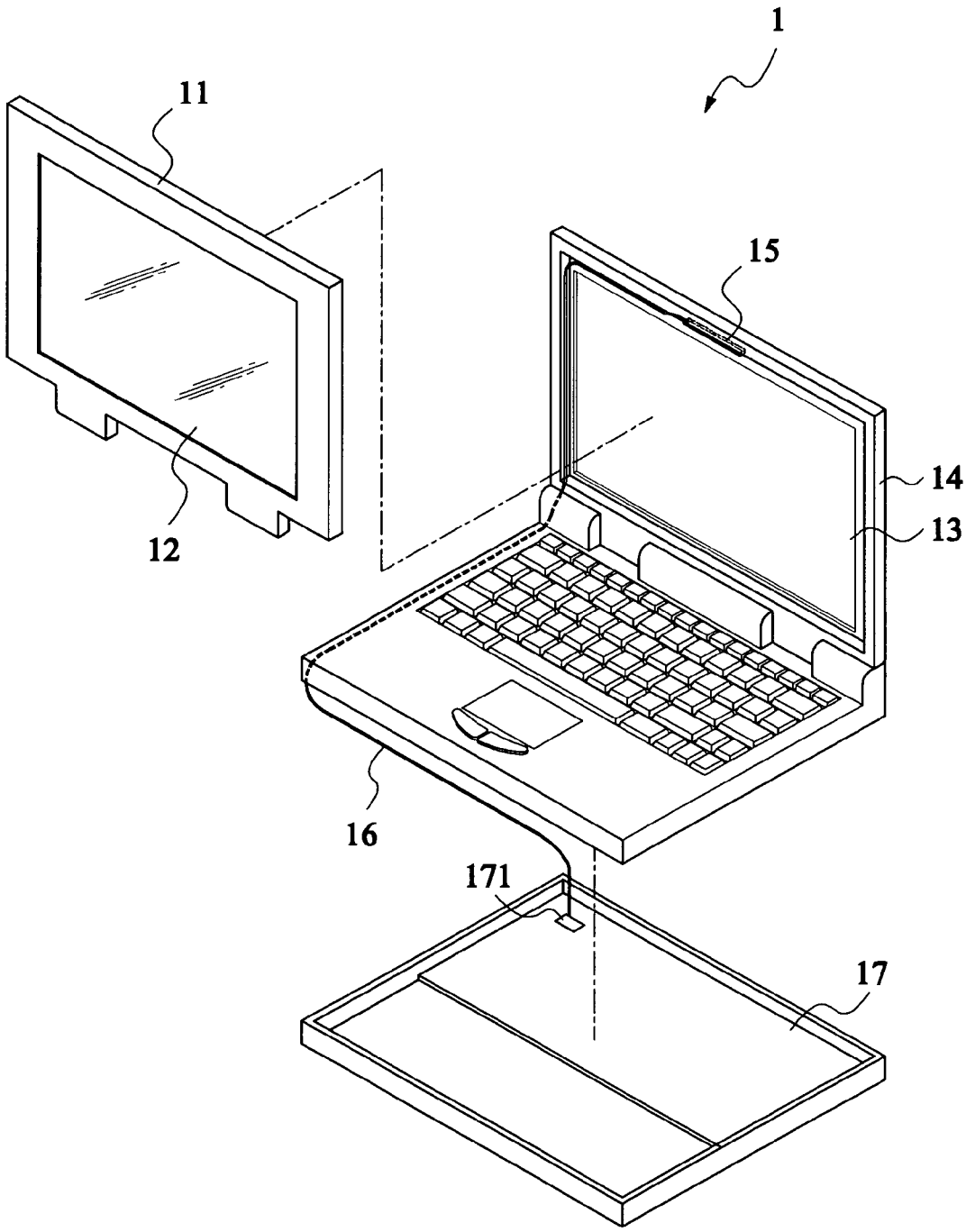
FIG.1(Prior Art)
FIG. 1 is an exploded perspective view of the conventional arrangement of the antenna used in an electronic device.
Figure 2:
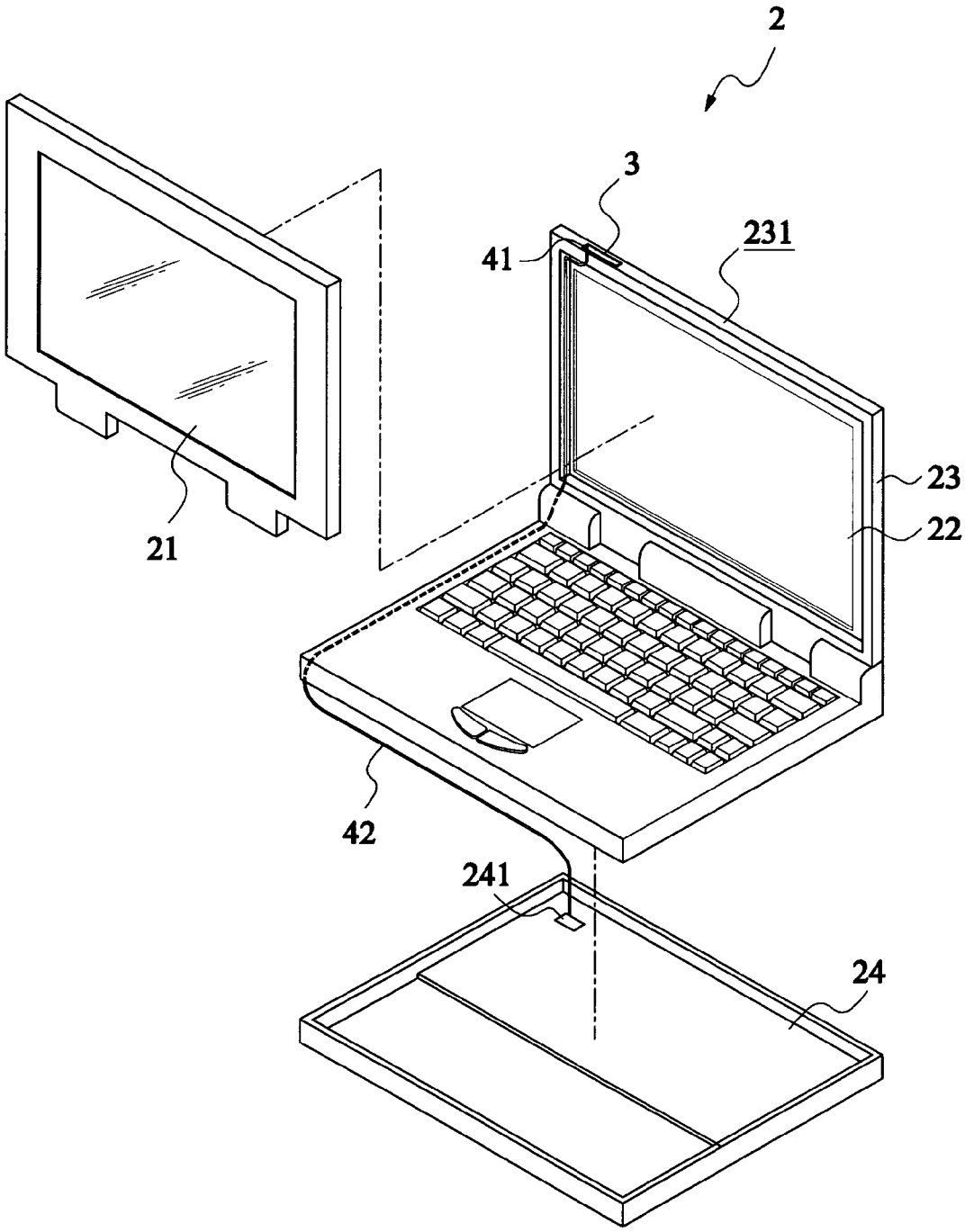
FIG. 2 is an exploded perspective view of an antenna device with an ion-implanted antenna pattern in accordance with a first embodiment of the present invention.
Figure 3:
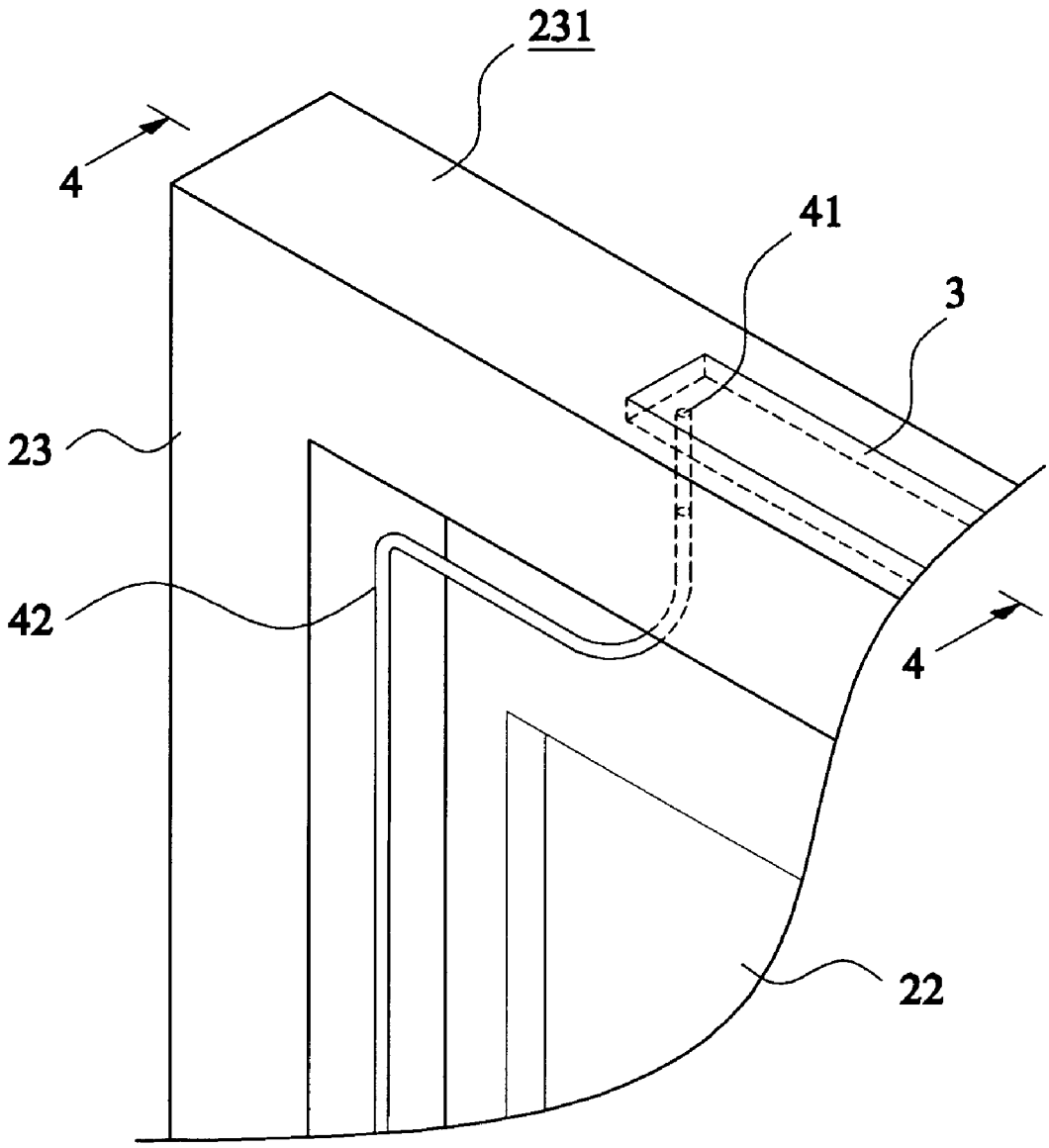
FIG. 3 is a partly enlarge view of the antenna device with an ion-implanted antenna pattern in accordance with the first embodiment of the present invention.
Figure 4:
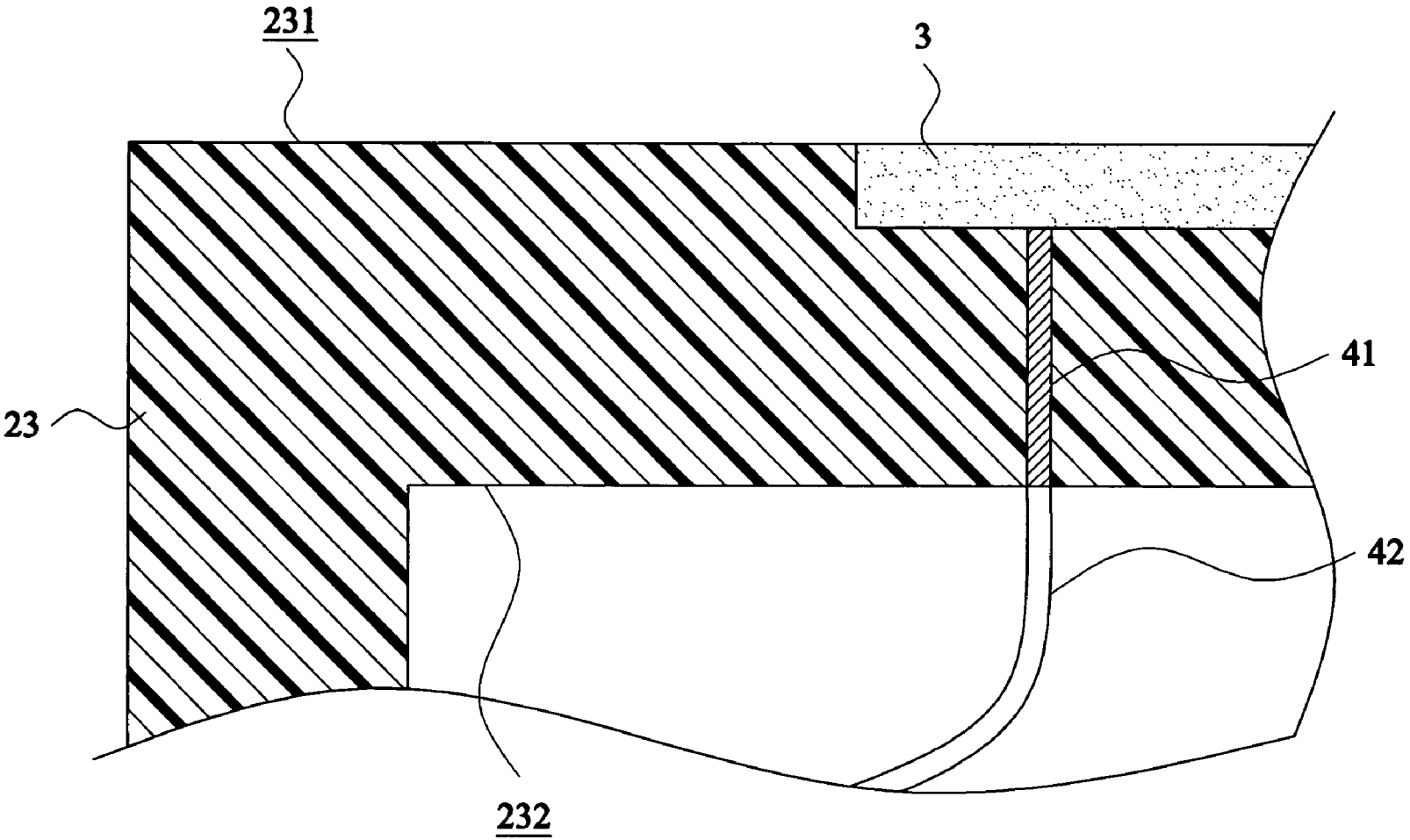
FIG. 4 is a sectional view taken along line 4-4 of FIG. 3.

With reference to the drawings and in particular to FIGS. 2 and 3 that is an exploded perspective view and a partly enlarged view, respectively, of an antenna device with an ion-implanted antenna pattern in accordance with a first embodiment of the present invention, and to FIG. 4 that is a sectional view taken along line 4-4 of FIG. 2. As shown in the figures, an electronic device 2 includes an ion-implanted antenna pattern 3 which is electronically connected to the electronic device 2 through a signal conducting member 41 and an antenna signal feeding line 42. Further, the ion-implanted antenna pattern 3 in the first embodiment is a plate antenna, and its structure and dimension, however, are changeable in accordance with the different desired application fields.

The electronic device 2 further includes a backlight module 21, an anti-EMI plate 22 which is used to protect the electronic device 2 from possible electromagnetic interference (EMI), a substrate 23 which includes a first surface 231 and a second surface 232, and a motherboard 24 including an antenna module 241.

Besides, the ion-implanted antenna pattern 3 is embedded in the first surface 231 of the substrate 23 and being connected to a first end of the signal conducting member 41, and a second end of the signal conducting member 41 is connected to the antenna signal feeding line 42 after the signal conducting member 41 passes through the substrate 23 and reaches the second surface 232. The signal conducting member, which includes a through hole and a coating of conductive materials such as tin and lead, is to electrically connect the ion-implanted antenna pattern 3 and the antenna signal feeding line 42.

The function of the signal conducting member 41 is to conduct the wireless signals transceived by the ion-implanted antenna pattern 3 to the antenna module 241 of the electronic device 2 through the antenna signal feeding line 42, and also to conduct the wireless signals generated by the antenna module 241 to the ion-implanted antenna pattern 3 through the same line 42. Such connection enables the transceiving and processing of wireless signals of the electronic device 2.

Figure 5:
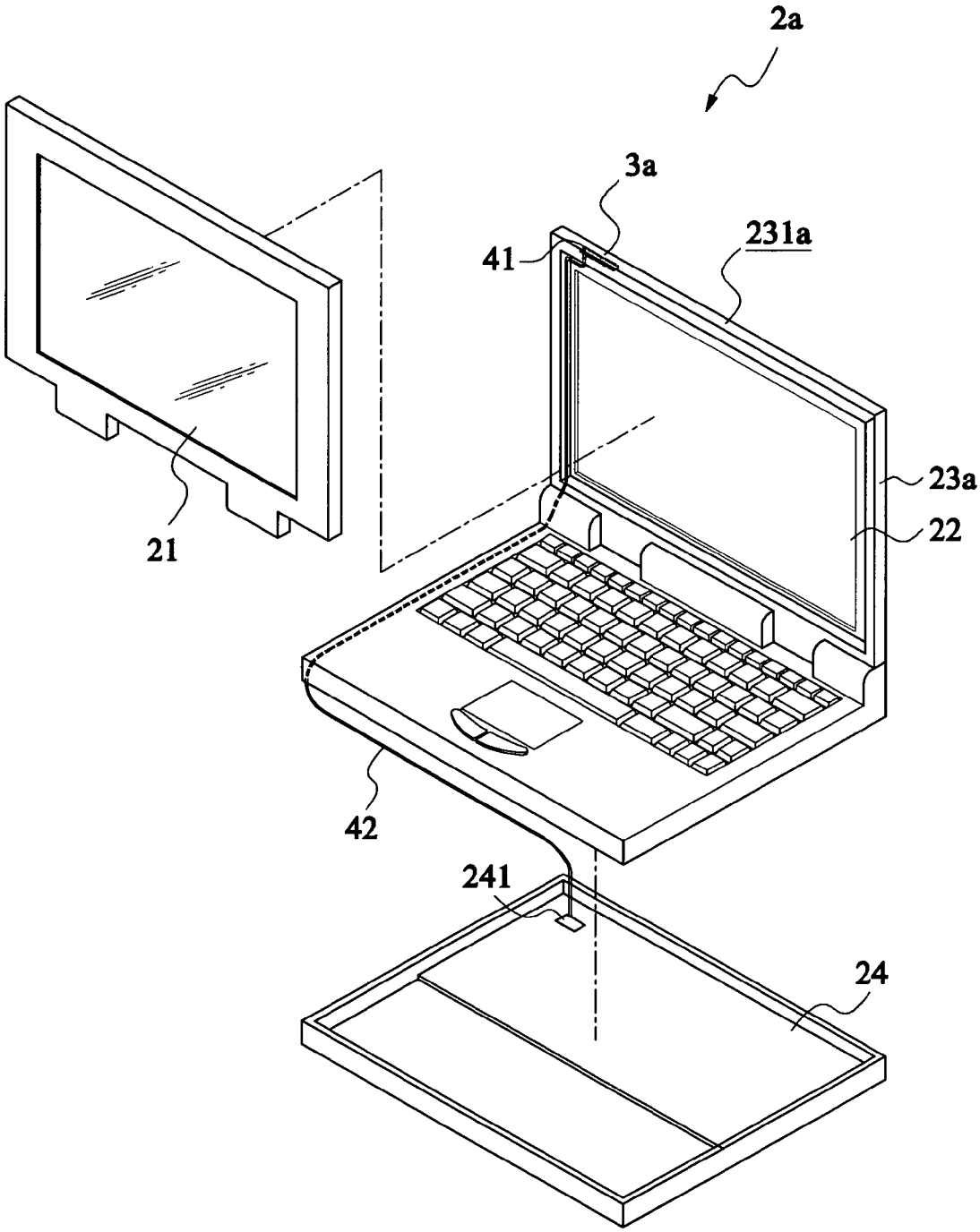
FIG. 5 is an exploded perspective view of an antenna device with an ion-implanted antenna pattern in accordance with a second embodiment of the present invention.
Figure 6:
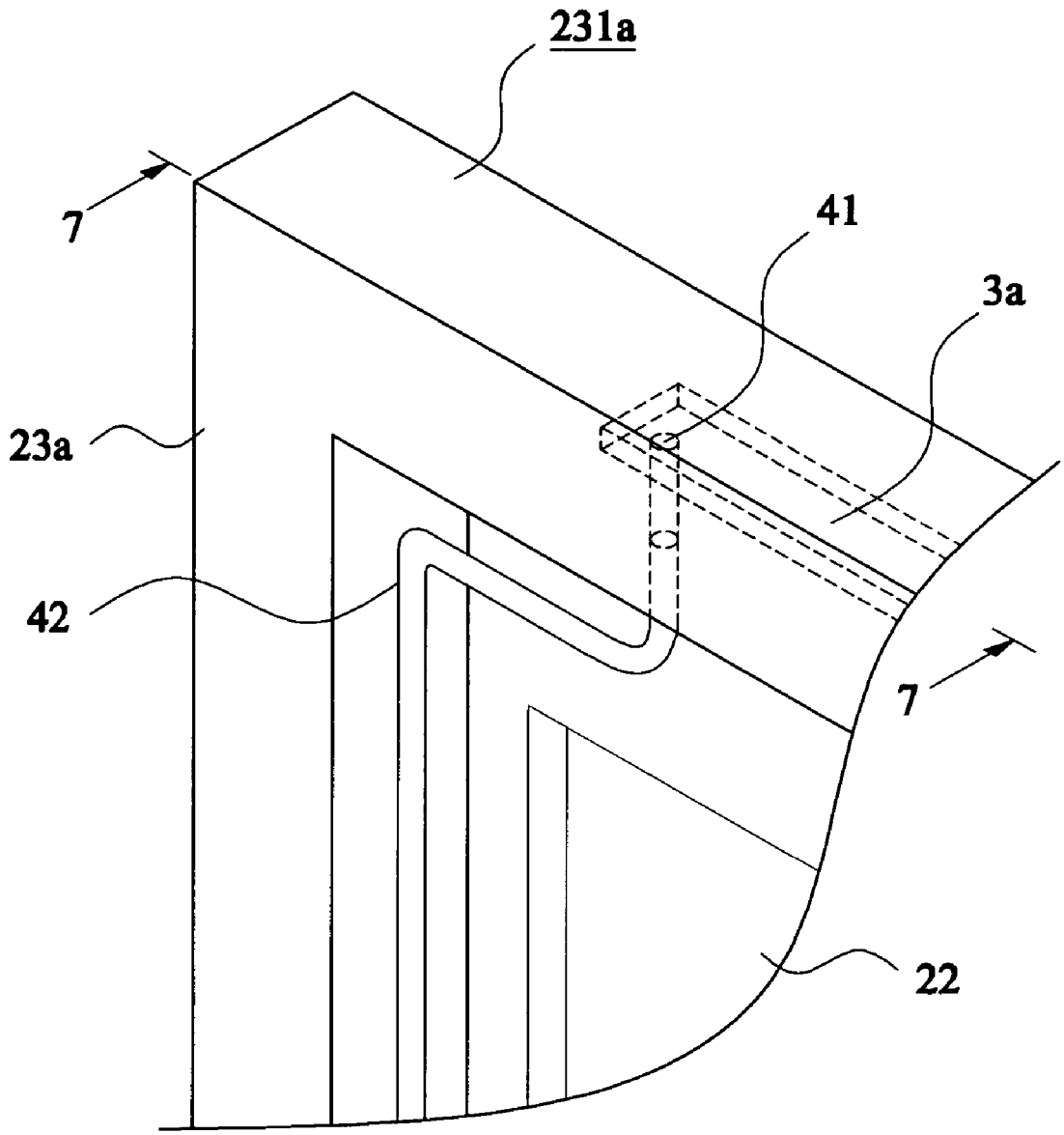
FIG. 6 is a partly enlarged view of the antenna device with an ion-implanted antenna pattern in accordance with the second embodiment of the present invention.
Figure 7:
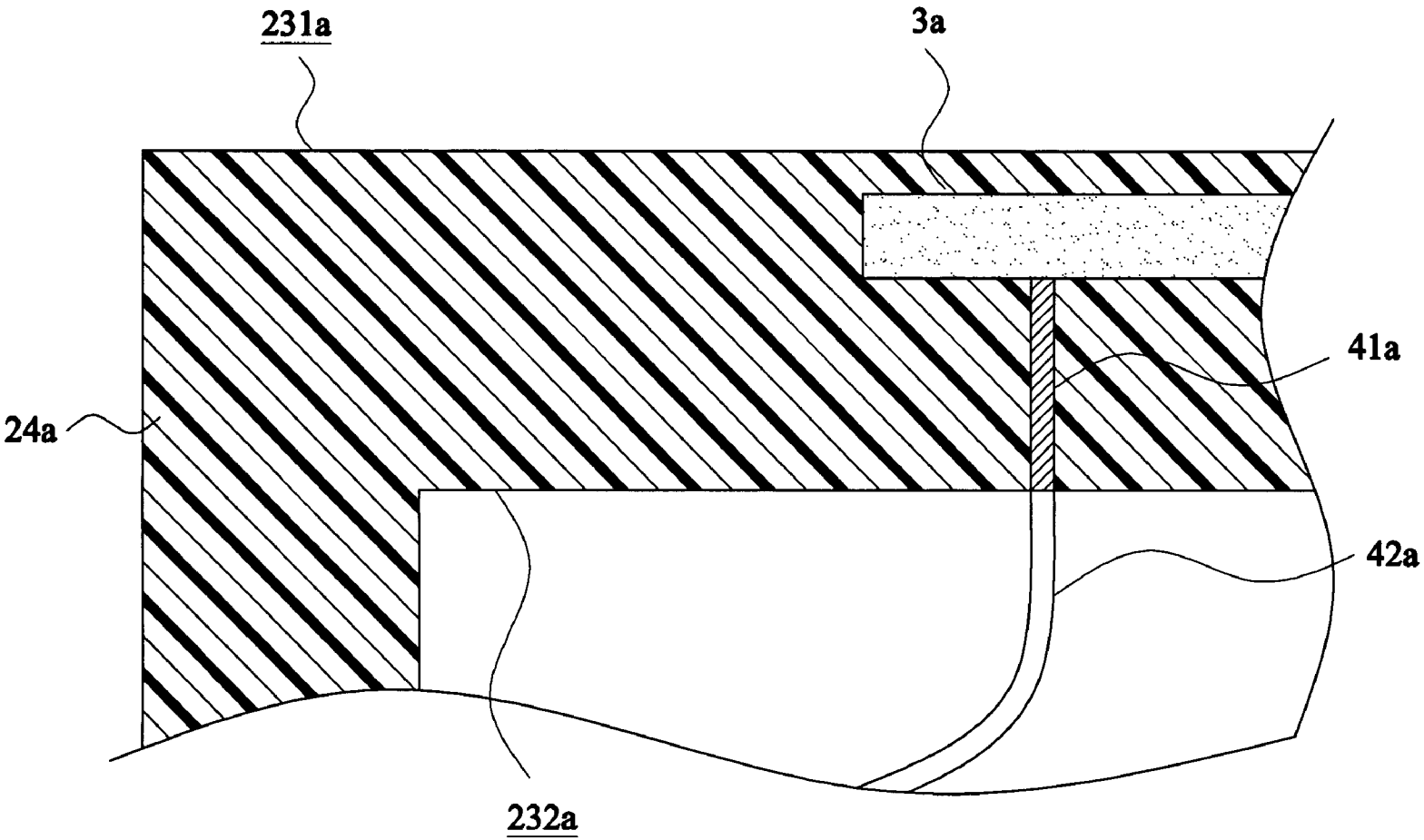
FIG. 7 is a sectional view taken along line 7-7 of FIG. 6.

Please refer to FIGS. 5 and 6, which are exploded perspective and partly enlarged views, respectively, of an antenna device with an ion-implanted antenna pattern of a second embodiment of the present invention, and to FIG. 7, which is a sectional view taken along line 7-7 of FIG. 6. As shown in the figures, an electronic device 2*a* includes a substrate 23*a* with a first surface 231*a* and a second surface 232*a*. The difference of the second embodiment from the first embodiment lies in the ion-implanted antenna pattern 3*a* forming inside the substrate 23*a* and adjacent to the first surface 231*a* of the substrate 23*a*.

Figure 8:
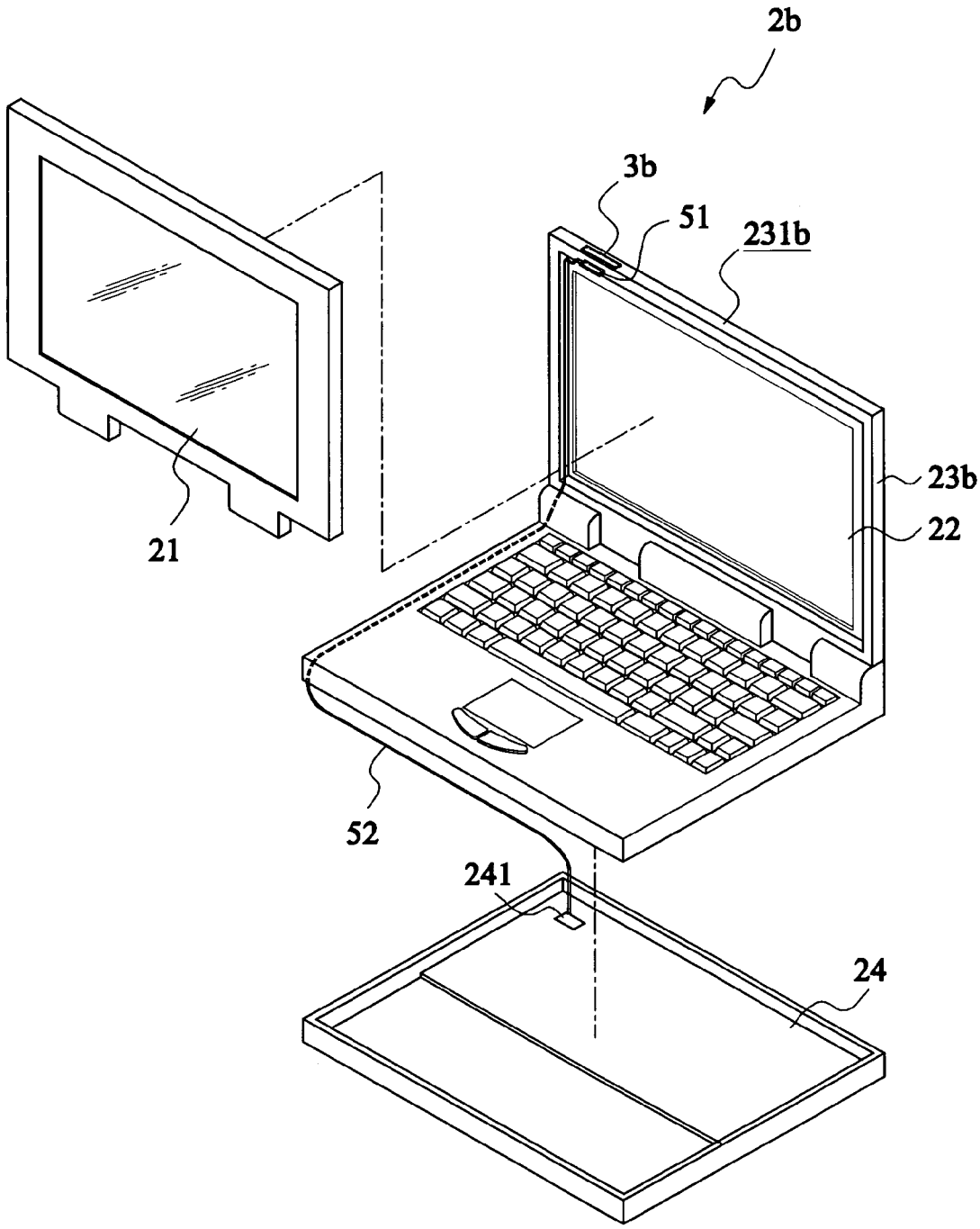
FIG. 8 is an exploded perspective view of an antenna device with an ion-implanted antenna pattern in accordance with a third embodiment of the present invention.
Figure 9:
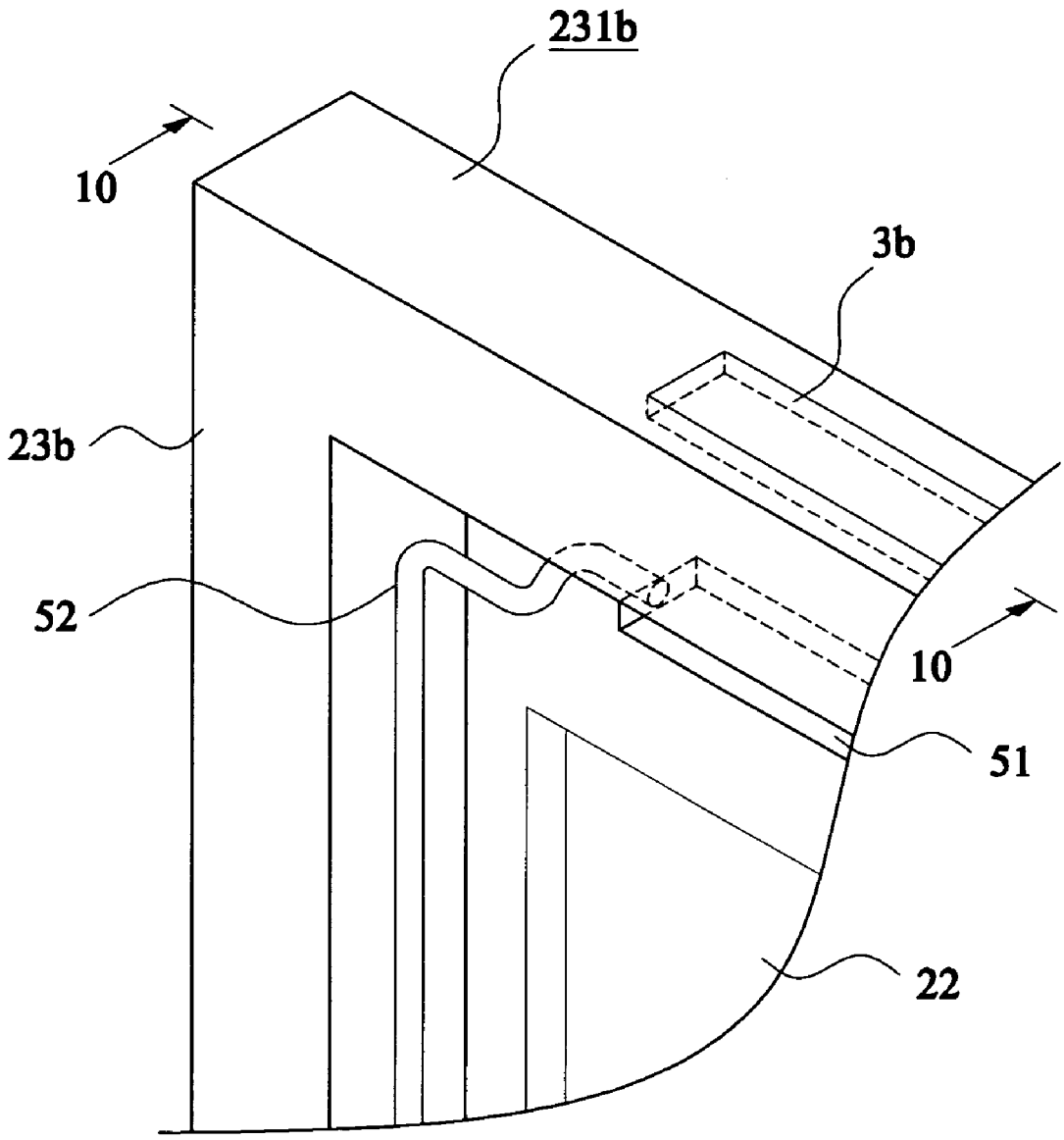
FIG. 9 is a partly enlarged view of the antenna device with an ion-implanted antenna pattern in accordance with the third embodiment of the present invention.
Figure 10:
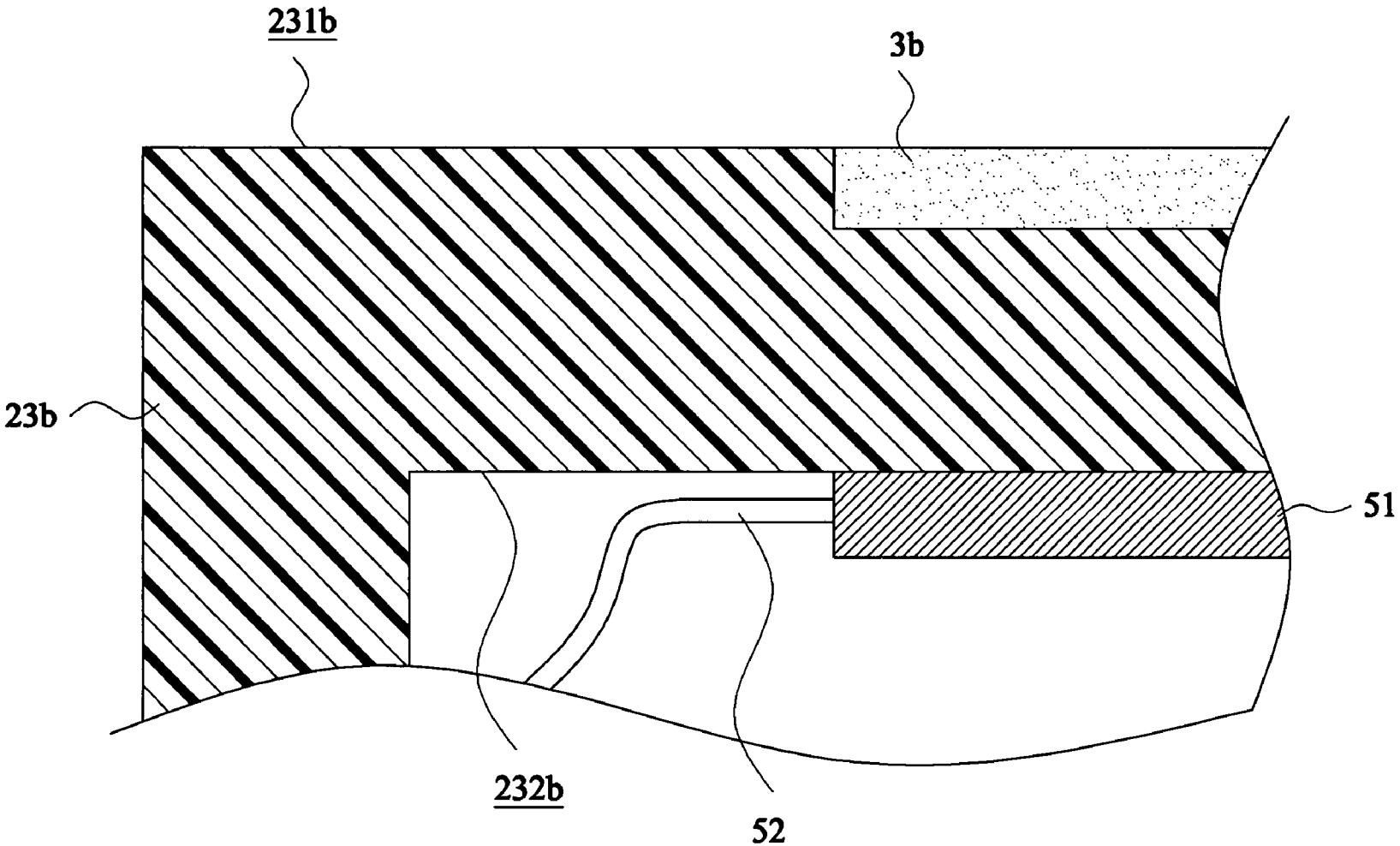
FIG. 10 is a sectional view taken along line 10-10 of FIG. 9.

As shown in the FIGS. 8 and 9, which is an exploded perspective view and a partly enlarged view, respectively, of an antenna device with an ion-implanted antenna pattern in accordance with the third embodiment of the present invention, and FIG. 10, which is a sectional view taken along line 10-10 of FIG. 8, an electronic device 2*b* includes an ion-implanted antenna pattern 3*b*, and the ion-implanted antenna pattern 3*b* is coupled to the electronic device 2*b* through an antenna coupling element 51 and an antenna signal feeding line 52. Further, the ion-implanted antenna pattern 3*b* is a plate antenna, and its structure and dimension, however, are changeable in accordance with the different desired application fields.

The electronic device 2*b* further includes an outer casing 21, an anti-EMI plate 22 which is used to protect the electronic device 2*b* from possible electromagnetic interference (EMI), a substrate 23*b* which includes a first surface 231*b* and a second surface 232*b*, and a motherboard 24 including an antenna module 241.

Besides, the ion-implanted antenna pattern 3*b* is embedded in the first surface 231*b* of the substrate 23*b* and coupled (with no direct wire connection) by the antenna coupling element 51, which is arranged on the second surface 232*b* of the substrate 23*b* and electrically connected to the antenna module 241 of the electronic device 2*b* by the antenna signal feeding line 52, in order to conduct the wireless signals transceived by the ion-implanted antenna pattern 3*b* from the antenna coupling element 51 to the antenna module 241 of the electronic device 2*b* through the antenna signal feeding line 52, and also to conduct the wireless signals generated by the antenna module 241 to the ion-implanted antenna pattern 3*b* through the same line 52. Such connection enables the transceiving and processing of wireless signals of the electronic device 2*b*.

Figure 11:
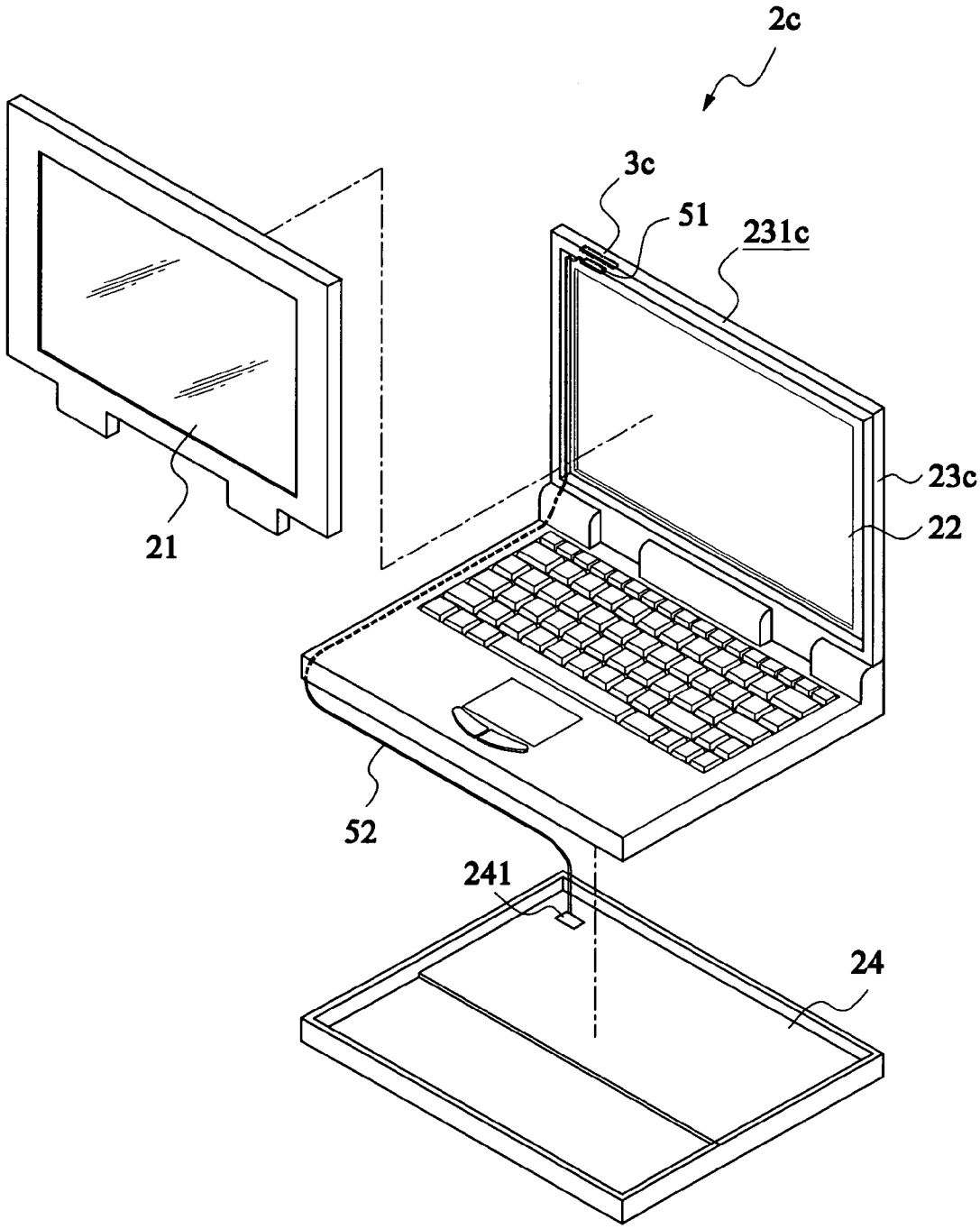
FIG. 11 is an exploded perspective view of an antenna device with an ion-implanted antenna pattern in accordance with a fourth embodiment of the present invention.
Figure 12:
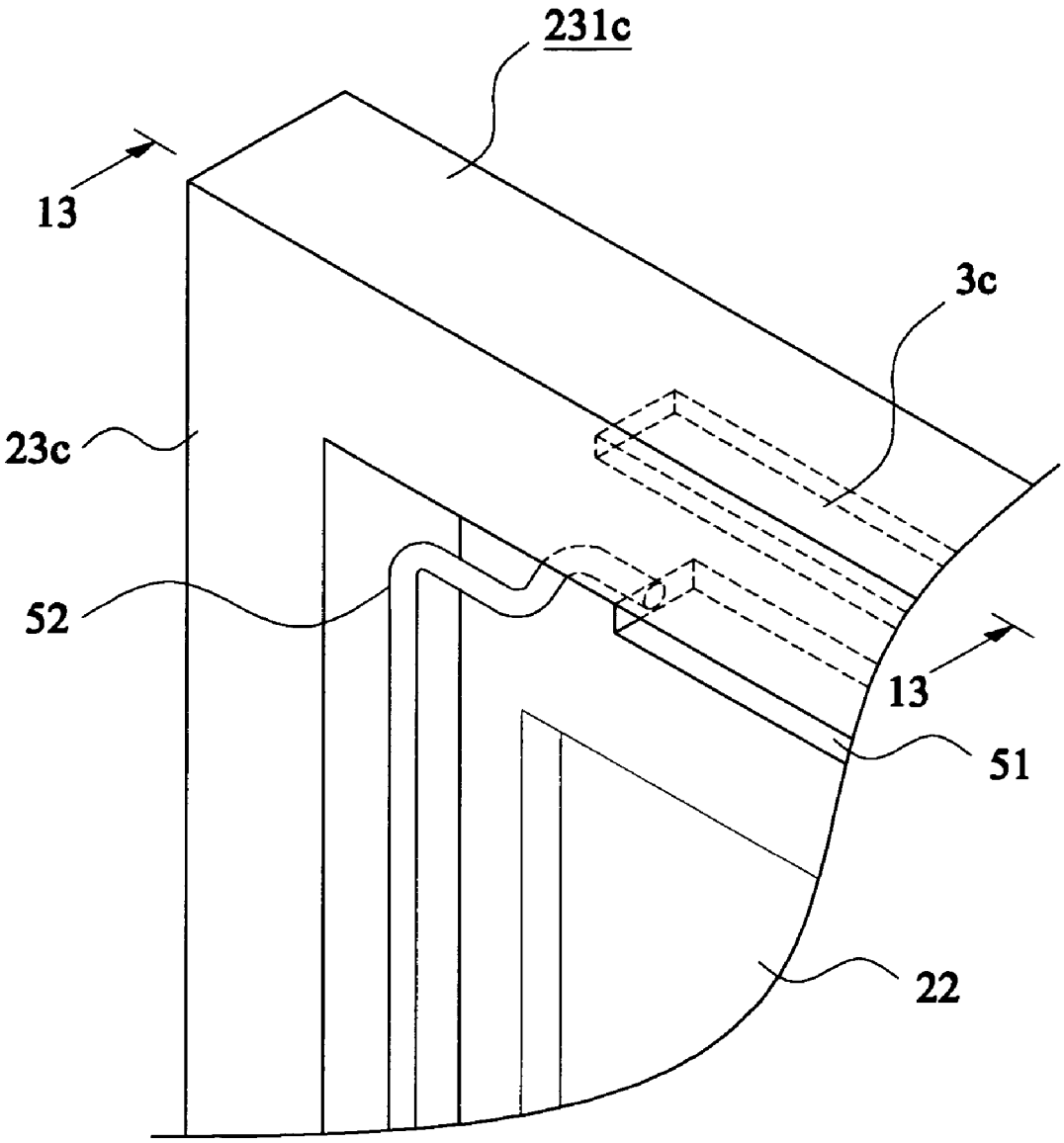
FIG. 12 is a partly enlarged view of the antenna device with an ion-implanted antenna pattern in accordance with the fourth embodiment of the present invention.
Figure 13:
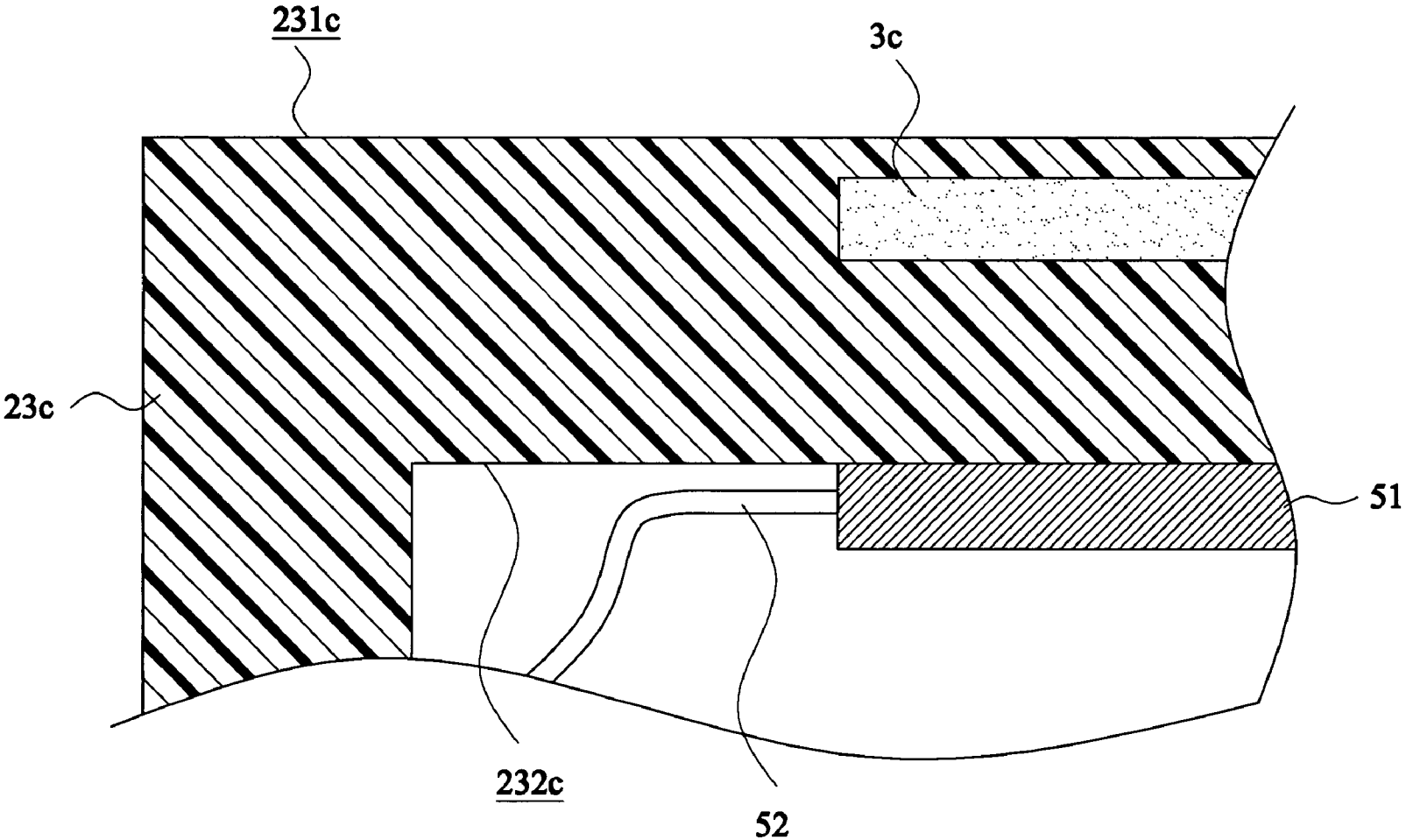
FIG. 13 is a sectional view taken along line 13-13 of FIG. 12.

Please refer to FIGS. 11 and 12, which are exploded perspective and partly enlarged views, respectively, of an antenna device with an ion-implanted antenna pattern of a fourth embodiment of the present invention, and to FIG. 13, which is a sectional view taken along line 13-13 of FIG. 11. As shown in the figures, an electronic device 2*c* includes a substrate 23*c* with a first surface 231*c* and a second surface 232*c*. The difference of the fourth embodiment from the third embodiment lies in the ion-implanted antenna pattern 3*c* forming inside the substrate 23*c* and adjacent to the first surface 231*c* of the substrate 23*c*.

The substrates 23, and 23*a* to 23*d* in the above embodiments of the present invention could be the casing of the electronic device, air, or a plastic plate when applied in different fields of application.

In the embodiments of the present invention, the forming of the antenna patterns 3, and 3*a* to 3*d* in/on the substrates 23, and 23*a* to 23*d* is by the process of Ion-Implantation, which atoms or molecules are ionized, accelerated in an electric field and implanted into the target material (the substrate in the present invention.) The antenna patterns, therefore, can be arranged at desired positions and depths in the substrate or have the desired structures and dimensions in accordance the field of applications.

From the above statement, the present invention directly implants an antenna pattern inside the structure of an electronic device by applying the process of Ion-Implantation accompanying a direct wire connection or a coupling feeding.

Further, the present invention can be adapted into a wide range of electronic devices when used in different fields of application.

While the invention has been described in connection with what is presently considered to the most practical and preferred embodiments, it is to be understood that the invention is not to be limited to the disclosed embodiments, but on the contrary, is intended to cover various modifications and equivalent arrangement included within the spirit and scope of the appended claims.

What is claimed is:

1. An antenna device, comprising:

a substrate having a first surface and a second surface;

an ion-implanted antenna pattern formed at a predetermined position of the substrate and formed by an Ion-implantation process for transceiving a wireless signal of a predetermined radiation frequency, wherein the substrate comprises at least one through hole communicating the second surface and a bottom surface of the ion-implanted antenna pattern;

a signal conducting member with a first end connecting to the ion-implanted antenna pattern and a second end extended to the second surface of the substrate, wherein the signal conducting member comprises a coating of conductive material coated on an interior wall of the through hole; and an antenna signal feeding line connecting to the signal conducting member for feeding the wireless signal transceived by the ion-implanted antenna pattern through the signal conducting member, wherein the ion-implanted antenna pattern is electrically connected to an antenna module of an electronic device through the signal conducting member and the antenna signal feeding line.

2. The antenna device as claimed in claim 1, wherein the ion-implanted antenna pattern is formed on the first surface of the substrate.

3. The antenna device as claimed in claim 1, wherein the ion-implanted antenna pattern is embedded in the substrate and formed with the first surface of the substrate.

4. The antenna device as claimed in claim 1, wherein the ion-implanted antenna pattern is formed inside the substrate and adjacent to the first surface of the substrate.

5. The antenna device as claimed in claim 1, wherein the through hole communicates the first surface and the second surface of the substrate.

6. The antenna device as claimed in claim 1, wherein the substrate is a casing of an electronic device.

* * * * *